US010239728B2

(12) United States Patent
Finn et al.

(10) Patent No.: US 10,239,728 B2
(45) Date of Patent: Mar. 26, 2019

(54) INTELLIGENT BUILDING SYSTEM FOR PROVIDING ELEVATOR OCCUPANCY INFORMATION WITH ANONYMITY

(71) Applicant: Carrier Corporation, Farmington, CT (US)

(72) Inventors: Alan Matthew Finn, Hebron, CT (US); William A. Veronesi, Hartford, CT (US); Arthur Hsu, South Glastonbury, CT (US); Hui Fang, Shanghai (CN)

(73) Assignee: CARRIER CORPORATION, Farmington, CT (US)

( * ) Notice: Subject to any disclaimer, the term of this patent is extended or adjusted under 35 U.S.C. 154(b) by 419 days.

(21) Appl. No.: 15/093,391

(22) Filed: Apr. 7, 2016

(65) Prior Publication Data

US 2016/0297642 A1 Oct. 13, 2016

Related U.S. Application Data

(60) Provisional application No. 62/145,198, filed on Apr. 9, 2015.

(51) Int. Cl.
*B66B 1/34* (2006.01)

(52) U.S. Cl.
CPC ..... *B66B 1/3476* (2013.01)

(58) Field of Classification Search
CPC ..... B66B 1/3476
USPC ..... 187/247, 380–388, 391, 392, 393, 396
See application file for complete search history.

(56) References Cited

U.S. PATENT DOCUMENTS 4,852,696 A * 8/1989 Fukuda ..... B66B 3/00 187/392
4,989,694 A * 2/1991 Ueshima ..... B66B 1/2458 187/380
5,042,620 A * 8/1991 Yoneda ..... B66B 1/34 187/382
5,258,586 A * 11/1993 Suzuki ..... B66B 1/2458 187/380
5,551,533 A * 9/1996 Ng ..... B66B 3/00 187/390
6,357,554 B1 * 3/2002 Valk ..... B66B 1/3484 187/292
7,575,103 B2 * 8/2009 Chiba ..... B66B 5/0012 187/247
7,610,995 B2 * 11/2009 Ylinen ..... B66B 1/34 187/381
7,712,586 B2 * 5/2010 Legez ..... B66B 1/20 187/387
7,793,762 B2 * 9/2010 Zaharia ..... B66B 1/462 187/391
8,020,672 B2 * 9/2011 Lin ..... B66B 1/34 187/316
8,540,057 B2 * 9/2013 Schuster ..... B66B 1/34 187/247
2005/0088520 A1 * 4/2005 Wiesinger ..... B66B 27/00 348/143

* cited by examiner

*Primary Examiner* — Anthony Salata
(74) *Attorney, Agent, or Firm* — Cantor Colburn LLP

(57) ABSTRACT

A system and/or method for detecting an occupancy of an elevator cab of an elevator to generate occupancy information is provided. The system and/or method further generates anonymized occupancy information based on the occupancy information and provides the anonymized occupancy information to enable the occupancy of the elevator cab to be presented with anonymity for occupants.

14 Claims, 4 Drawing Sheets

INTELLIGENT BUILDING SYSTEM FOR PROVIDING ELEVATOR OCCUPANCY INFORMATION WITH ANONYMITY

DOMESTIC CLAIM FOR PRIORITY

This application is a Non-Provisional of U.S. Provisional Application No. 62/145,198 filed Apr. 9, 2015.

BACKGROUND

The disclosure relates generally to an intelligent building system for providing occupancy information with anonymity.

Elevator cabs have finite capacity and, when full, may bypass a hall call ("load bypass") to increase throughput and, thereby, minimize overall passenger wait time. The bypass feature, in general, is implemented by estimating elevator cab occupancy with load sensors. Unfortunately, load is not directly related to area occupancy, particularly when the elevator is transporting people in wheelchairs, or there are luggage carts, hospital gurneys, etc. This may result in a cab stopping unnecessarily or bypassing a hall call unnecessarily.

That is, bypassing a hall call is potentially annoying to waiting passengers who sent the hall call and only know that an elevator cab did not stop for them. Without additional information, the waiting passengers do not know why the cab did not stop and may assume the hall call button is broken. Further, with some elevator cabs, the bypass feature can be itself disabled so that a full car will stop, open and close its doors, and then resume its trip despite not having the capacity to receive additional passengers. Disabling the bypass feature may help relieve the annoyance and stress of the waiting passengers, but at an expense of longer travel times for current passengers.

SUMMARY

According to one embodiment of the present invention, a method that comprises detecting an occupancy of an elevator cab of an elevator to generate occupancy information; generating anonymized occupancy information based on the occupancy information; and providing the anonymized occupancy information to enable the occupancy of the elevator cab to be presented with anonymity for occupants is provided.

According to another embodiment or the above embodiment, wherein the detecting of the occupancy of the elevator cab of the elevator to generate occupancy information can further comprise capturing by a detector images of an inside of the elevator cab.

According to another embodiment or any of the above embodiments, the occupants can include mobile entities and accoutrement of the mobile entities.

According to another embodiment or any of the above embodiments, the anonymized occupancy information can include a real-time image stream of the elevator cab with each occupant anonymized.

According to another embodiment or any of the above embodiments, a display in an elevator lobby can be configured to perform the providing of the anonymized occupancy information.

According to another embodiment or any of the above embodiments, the method can further comprise receiving a request for the occupancy information initiated by a device external to the processor.

According to another embodiment or any of the above embodiments, the method can further comprise providing an image rectified with obscuration to a device to enable the occupancy of the elevator cab to be presented via the display of the device with anonymity.

According to another embodiment or any of the above embodiments, a computing device of an elevator sub-system can be configured to control operations of the elevator including a bypass feature with respect to the occupancy of the elevator cab.

According to another embodiment or any of the above embodiments, the occupancy information can include a total number of occupants or a location of each occupant.

According to another embodiment or any of the above embodiments, the generating of the anonymized occupancy information based on the occupancy information can include generating an image rectified with obscuration.

According to one embodiment of the present invention, a system comprises a detector configured to detect an occupancy of an elevator cab of an elevator and to provide occupancy information based on the detection of the occupancy; and a processor, communicatively coupled to the detector, configured to receive the occupancy information from the detector and to generate anonymized occupancy information based on the occupancy information, wherein the anonymized occupancy information enables the occupancy of the elevator cab to be presented with anonymity for occupants.

According to an embodiment or the above embodiment, the detector can be a camera configured to capture images of an inside of the elevator cab in support of the detecting of the occupancy of the elevator cab of the elevator to generate occupancy information.

According to another embodiment or any of the above embodiments, the processor can be a computing device of an elevator sub-system of the system, and wherein the computing device can be configured to control operations of the elevator including a bypass feature with respect to the occupancy of the elevator cab.

According to another embodiment or any of the above embodiments, the occupancy information can include a total number of occupants or a location of each occupant.

According to another embodiment or any of the above embodiments, the processor can be configured to generate the anonymized occupancy information based on the occupancy information to include an image rectified with obscuration.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Embodiments relate to an intelligent building system for providing occupancy information with anonymity, and more particularly, to providing elevator information, including anonymized cab occupancy information, to potential elevator users. The occupancy information can explicitly include both the human occupants, such as the number of people; mobile entities, such as luggage carts, animal crates, hospital gurneys, etc.; and accoutrement of the mobile entities, such as luggage, pets, patients, etc. Further, the occupancy information can include autonomous entities such as robots, automated delivery vehicles, contents of robots and vehicles, etc.

In general, embodiments of the present invention disclosed herein may include an intelligent building system, method, and/or computer program product (herein "intelligent building system") that utilizes a detector to monitor an occupancy of an elevator and notifies a user of the occupancy with anonymity to the occupants when the user makes a hall call. In this way, the embodiments of the present invention improve upon existing building and elevator schemes by adding/modifying operations and/or devices of those schemes to present elevator occupancy information and thereby reduce annoyance and stress of the users (e.g., waiting passengers).

Figure 1:
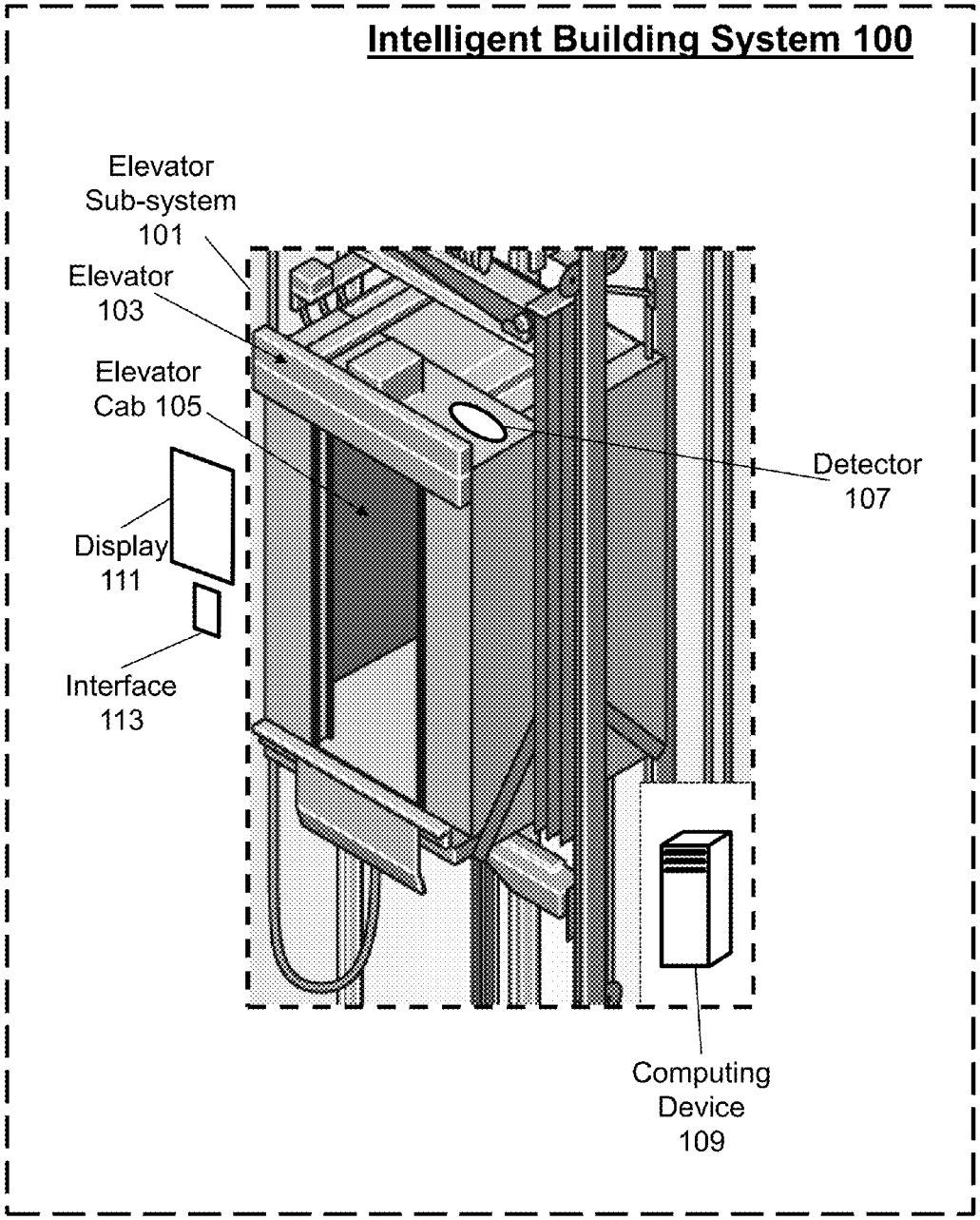
FIG. 1 illustrates an example of a schematic of an intelligent building system according to one embodiment.

Referring now to FIG. 1, an example schematic of an intelligent building system 100 is shown. The intelligent building system and elements therein may take many different forms and include multiple and/or alternate components and facilities. The intelligent building system 100 is only one example of an intelligent building system and is not intended to suggest any limitation as to the scope of use or operability of embodiments of the invention described herein (indeed additional or alternative components and/or implementations may be used). The intelligent building system 100 includes an elevator sub-system 101. The elevator sub-system 101 comprises an elevator 103 that includes an elevator cab 105, a detector 107, and a computing device 109. Further, the intelligent building system 100 includes a display 111 and an interface 113.

The intelligent building system 100 may implement operations and/or communicate signals between the elevator sub-system 101 and elements therein, the display 111, the interface 113, and other systems and sub-systems that assist users of the elevator 103. Examples of operations and/or signals may include generating an elevator call (e.g., a hall call), canceling an elevator call, detecting occupants, receiving requests for occupancy information, obscuring the occupancy information, providing notifications to the users, etc. Further, the communications of the intelligent building system 100 can be encrypted, e.g., a protocol such as hypertext transfer protocol secure (HTTPS) for communication to a mobile browser or an advanced encryption standard (AES) for communication to a display. Further, the intelligent building system 100 can utilize the same protocols, and even hardware, for its components as are used by a user and a user device to leverage cost and implementation benefits.

The elevator sub-system 101 can comprise electromechanical arrangements (e.g., a controller and/or computing device, such as computing device 109, that communicates with at least one motor) that control speed, position, and door operation of an elevator or bank of elevators (e.g., elevator 103). The elevator cab 105 has a finite capacity to hold occupants, which include objects and people, based on the dimensions of the elevator.

The computing device 109 of the elevator sub-system 101 may control and monitor (or communicate with other systems and sub-systems through any network communication technologies that can control and monitor) the elevator 103, the elevator cab 105, and the detector 107, such that the elevator sub-system 101 may operate the elevator or bank of elevators as a user or a user device interacts with the intelligent building system 100 (e.g., makes hall calls or requests occupancy information). Examples of communication technologies include electromagnetic, e.g., radio frequency ("RF"), magnetic (near field communication, "NFC"), short wave radio, proximity systems, Bluetooth Low Energy (BLE) beacons, etc. Further schematics of the computing device 109 and communication technologies are described below with respect to FIG. 4. The computing device can also implement a bypass feature, communicate with devices external to the intelligent building system 100, perform additional reliability and convenience communication operations, e.g., a time-out feature to long-term cellular communication, etc.

The detector 107 can be any sensor that detects events or changes in quantities and provides a corresponding output. For instance, the detector or occupied-area estimation device may generally capture, record, identify, and/or calculate a total occupancy of the elevator cab 105 and/or a volume of each occupant of the elevator cab 105, and output occupancy information as an electrical or optical signal to the computing device 109, the display 111, or other device that reflects the total occupancy and/or the volume. The occupancy information can be expressed as an image, but in alternate embodiments can be expressed as text or through mathematics, e.g., a percentage of occupied floor area. Examples of a detector 107 include cameras, infrared sensors, motion sensors, radar, lidar, sonar, ultrasound, depth sensors, microphones, etc. Further, detector 107 may be connected to the computing device 109, the display 111, or other device through either wired (traveling cable) or wireless communication. If the communication is wireless, a short range communication technology can be utilized with additional privacy protection so that any information communicated is protected from intrusion.

The display 111 can be any output device or technology for presentation of occupancy information. One embodiment of the display 111 includes an electronic visual display configured near an entry way of the elevator 103 from an elevator lobby (e.g., as shown in FIG. 1) that outputs images transmitted electronically from the detector 107 or the computing device 109 for visual reception by a waiting passenger. Another embodiment of the display 111 includes a user device that is in communication with the intelligent building system 100 and incorporates the display 111. Examples of a display include light emitting diode displays, liquid crystal displays, flat panel displays, etc.

The interface 113 can be any shared boundary across which two separate entities exchange information. The exchange can be between software, computer hardware, peripheral devices, humans, and combinations of thereof. In turn, embodiments of the interface 113 can include barcodes, two-dimensional barcodes (e.g., as a quick response code), near field communications transmitters, etc. that in response to a user device scanning or interacting with the interface 113 causes the user device to connect with the intelligent building system 101 and receive the occupancy information. Further, the interface may also be integrated with the display 111 such as a combination of the display with a touchscreen creating an interface that can display the occupancy information and accept user inputs.

Figure 2:
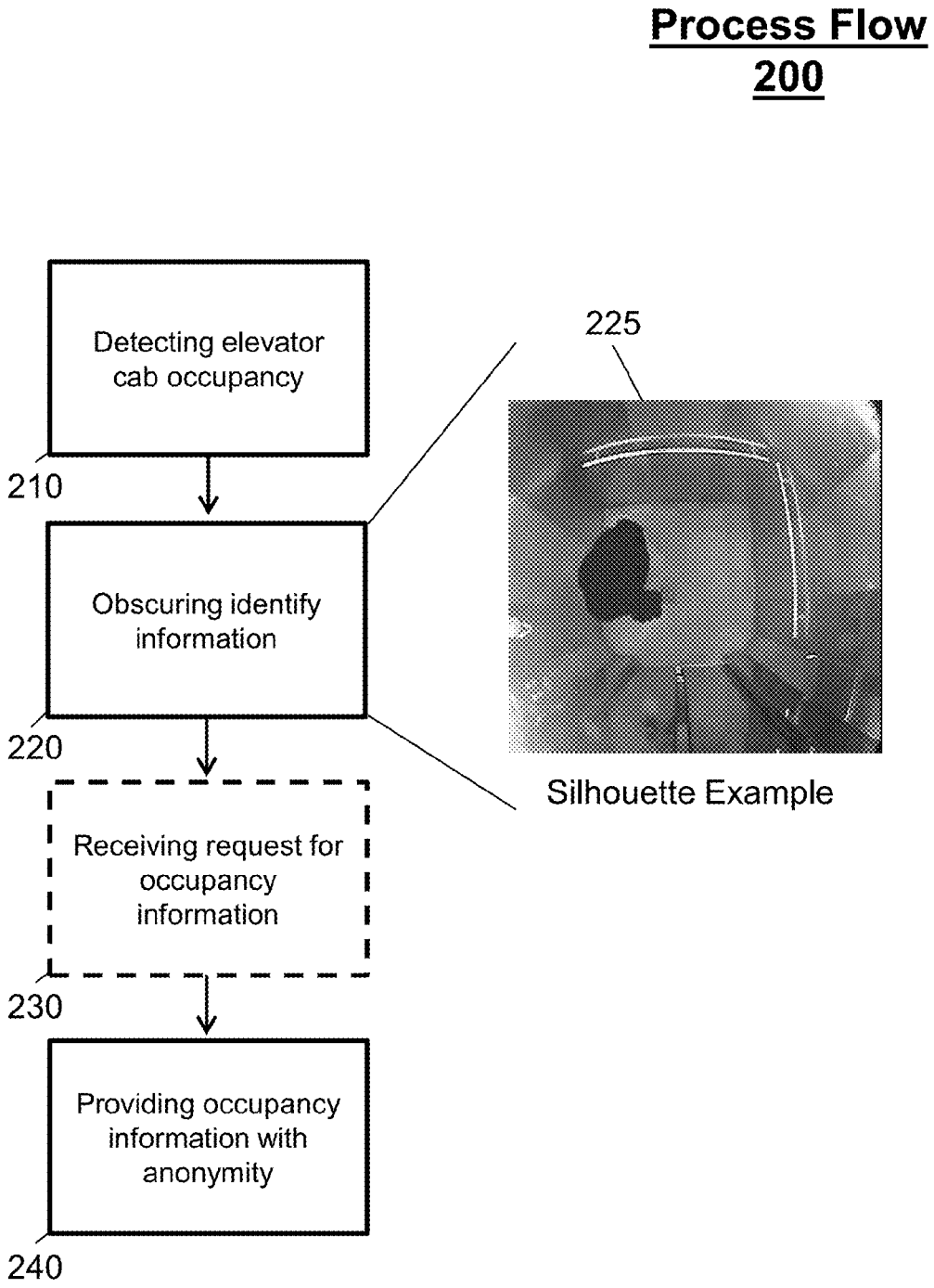
FIG. 2 illustrates a process flow by an intelligent building system according to one embodiment.

Operations of the intelligent building system 100 will now be described. In general, occupancy of the elevator cab 105 can be visually displayed at a floor on the display 111, which may be actual imagery, obscured imagery, a cartoon format, or textually. Further, the occupancy can also be transmitted to a user device upon request or in response to an elevator call, such as when a user device (e.g., cellular phone, tablet computer, etc.) scans a code to receive elevator cab occupancy information on the user device or can specify the elevator of interest in any other way. Note that the information provided need not be restricted to elevator cab occupancy, but cab occupancy has particular value when the cab is full and will not stop for a hall call on the waiting passenger's floor. The occupancy information may include expected next cab arrival time, alternative elevator selection, elevator position, elevator motion, known stops of all the elevators in a bank, recommended alternative elevator, etc. In the case of emergency, when an elevator should not be used, the information might consist of escape routes, places of refuge, etc. An example of a set of operations by the intelligent building system 100 will be described with reference to FIG. 2, which illustrates a process flow 200.

Process flow 200 begins at start block 210 where the intelligent building system 100 utilizes the detector 107 to detect the occupancy of the elevator cab 105. Next, in block 220, the identity information of the occupants is obscured. In one embodiment, the detector 107 is a camera equipped with a processor that captures images or video of the inside of an elevator 103 (e.g., elevator cab 105). The processor may also perform image rectification to correct the effects of distortion from camera mounting location, lens effects, etc. In another embodiment, the detector 107 may directly provide the captured images or video to the computing device 109, the display 111, and/or the user device, which in turn locally performs the image rectification.

Next, at block 220, the intelligent building system 100 utilizes the detector 107 (and computing device 109) to detect and implement privacy protection on the images or video by image processing and/or masking technology that obscure the identification of the people or objects (e.g., occupants) within the elevator cab 105. For example, using a camera as the detector 107, the computing device 109 may utilize video based background learning and foreground detection, such as a Gaussian Mixture Model foreground object segmentation. The obtained foreground information can be obscured, for instance, by replacing the foreground pixel color with black to create a silhouette. As shown in the Silhouette Example 225 of FIG. 2, the detector 107 and computing device 109 may produce an image where the occupant is a silhouette within the elevator cab 105. In some instances, the images or video may be processed to depict a cartoon image of the elevator cab 105. Similar to block 210, other embodiments of the intelligent building system 100 enable the detector 107 to directly provide the captured images or video to another device for the image processing, e.g., the computing device 109, the display 111, and/or the user device, which in turn locally performs the image processing.

Then, at block 230, the intelligent building system 100 receives a request for occupancy information. Block 230 is shown with a dashed-line to illustrate that receiving the request may be optional because the detector 107 of the intelligent building system 100 may already be automatically providing the obscured rectified image to the display 111. The request may be generated by a hall call, an elevator call through a mobile device or device external to the elevator sub-system 101, a direct interaction with the display 111, a direct interaction with the interface 117, on a periodic basis, etc.

Next, at block 240, the intelligent building system 100 provides occupancy information with anonymity. For example, the detector 107 can automatically present the obscured rectified image to the display 111 (e.g., real-time imagery). The display 111 can also provide the occupancy information with anonymity and/or obscured rectified image in any form that accurately represents the occupancy of the elevator cab 105. Additionally, the occupancy information with anonymity can be provided inside the elevator cab 105 to demonstrate to passengers that the estimate is accurate and thereby convince them that accurate decisions are being made when they are bypassed.

Figure 3:
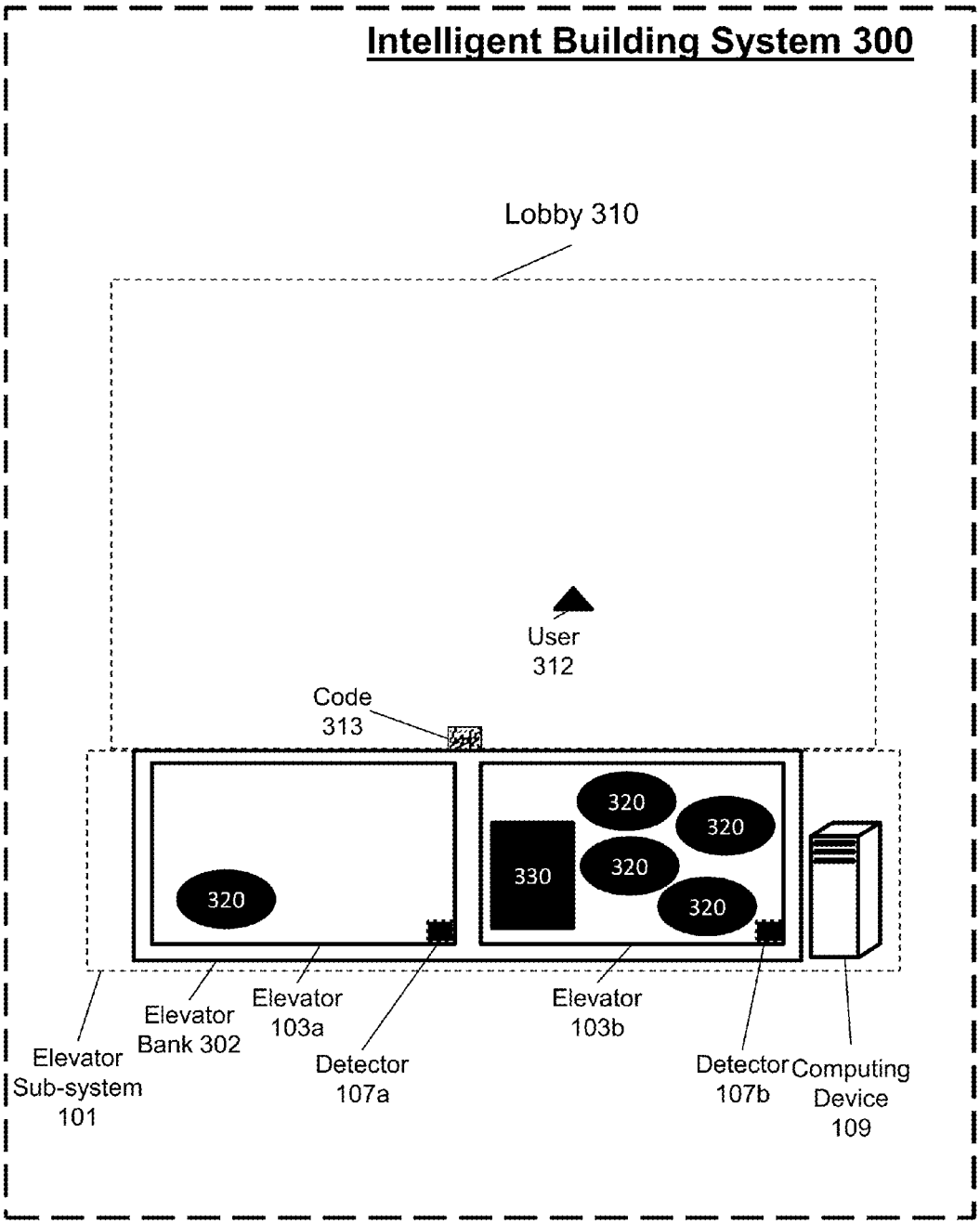
FIG. 3 illustrates an example of another schematic of an intelligent building system according to one embodiment.

Embodiments of the present invention will now be described with respect to a bypass feature and particularly with respect to FIG. 3. FIG. 3 is a floor-plan schematic of an intelligent building system 300 with respect to a particular intermediate floor (e.g., between the bottom and top floors). The intelligent building system 300 and elements therein may take many different forms and include multiple and/or alternate components and facilities. The intelligent building system 300 is only one example of an intelligent building system and is not intended to suggest any limitation as to the scope of use or operability of embodiments of the invention described herein (indeed additional or alternative components and/or implementations may be used).

The intelligent building system 300 includes the elevator sub-system 101. The elevator sub-system 101 in this embodiment comprises an elevator bank 302 that includes two elevators 103*a*, 103*b*, each of which has a corresponding detector 107*a*, 107*b* that monitors occupancy. Further, intelligent building system 300 also illustrates that, within a lobby 310 of the intermediate floor, a user 312 is waiting for one of the elevators 103*a*, 103*b* and code 313 (e.g., interface 113) is oriented on an elevator side of the lobby 310.

In one operation example, the user 312 presses a call button to initiate a hall call for one of the elevators 103*a*, 103*b*. Further, the user 312 also utilizes a user device to scan the code 313. Based on the scanning of the code 313, the user device automatically connects to the computing device 109 through a wireless network and requests occupancy information for the elevators 103*a*, 103*b*. In alternative embodiments, a user device may detect the elevator of interest by other means, e.g., the use of wifi beacons, dedicated beacons, near-field communication (NFC), etc. in proximity to the elevator.

In response, the computing device 109 causes a prompt or notification indicating that the elevator call has been made on the user device, along with other elevator information (e.g., assignment of the elevator 103*b*). Further, the computing device 109 connects with the detector 107*b* to acquire occupancy information. The detector 107*b* identifies that the elevator 103*b* is unoccupied and feeds this occupancy information back to the user device through the computing device 109, which is then displayed to user 312 by the user device. In alternative embodiments, the occupancy information may be conveyed to an interested user through other methods such as, display 111, an audio output device (for the convenience of visually impaired people), etc.

Referring now to FIG. 3, while the elevator 103*b* is traveling to pick up the user, it may acquire a number of passengers 320 and objects such as cart 330. Unfortunately for the user, this number is equal to a maximum capacity of the elevator 103*b*. Therefore, before the elevator 103*b* arrives at the intermediary floor, the detector 103*b* identifies that the elevator 103*b* is full and triggers a bypass feature in the computing device 109. Next, the computing device 109 reassigns the elevator 103*a* to the hall call and enables the user to see the occupancy of both elevators 103*a*, 103*b*, as detected by the corresponding detectors 107*a*, 107*b*. In this way, the annoyance and/or stress of waiting for one of the elevators 103*a*, 103*b* of the elevator bank 302 for the user 312 is mitigated because the user 312 ascertains through the user device that the first assigned elevator filled up and another elevator is being dispatched.

Figure 4:
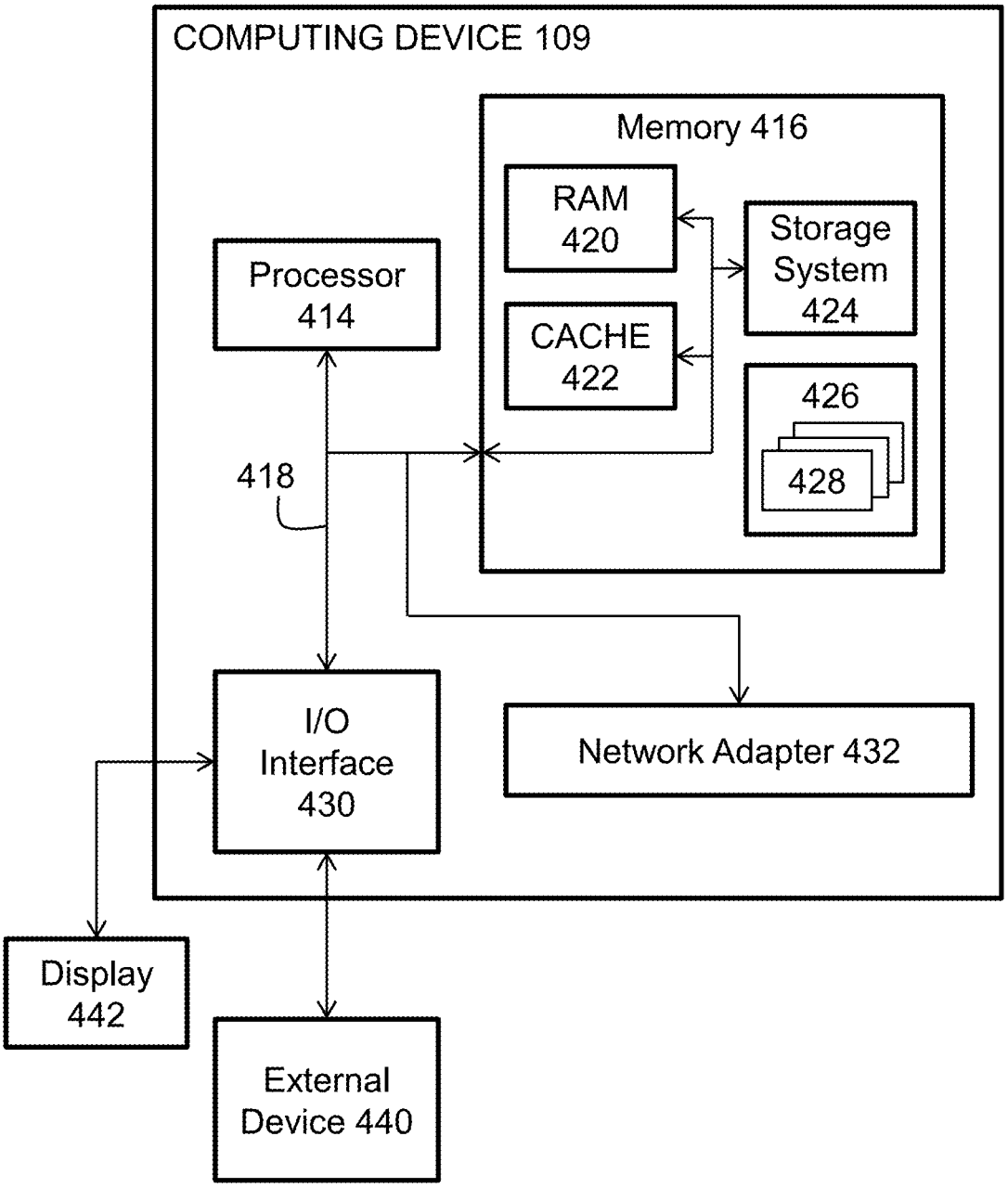
FIG. 4 illustrates a computing device schematic of an intelligent building system according to one embodiment.

Referring now to FIG. 4, an example schematic of a computing device 109 of an intelligent building system is shown. The computing device 109 is only one example of a suitable computing node and is not intended to suggest any limitation as to the scope of use or operability of embodiments of the invention described herein (indeed additional or alternative components and/or implementations may be used). That is, the computing device 109 and elements therein may take many different forms and include multiple and/or alternate components and facilities. Further, the computing device 109 may be any and/or employ any number and combination of computing devices and networks utilizing various communication technologies, as described herein. Regardless, the computing device 109 is capable of being implemented and/or performing any of the operations set forth hereinabove.

The computing device 109 can be operational with numerous other general-purpose or special-purpose computing system environments or configurations. Systems and/or computing devices, such as the computing device 109, may employ any of a number of computer operating systems. Examples of computing systems, environments, and/or configurations that may be suitable for use with the computing device 109 include, but are not limited to, personal computer systems, server computer systems, thin clients, thick clients, handheld or laptop devices, multiprocessor systems, microprocessor-based systems, set top boxes, programmable consumer electronics, network PCs, minicomputer systems, computer workstations, servers, desktops, notebooks, network devices, mainframe computer systems, and distributed cloud computing environments that include any of the above systems or devices, and the like.

The computing device 109 may be described in the general context of computer system executable instructions, such as program modules, being executed by a computer system. Generally, program modules may include routines, programs, objects, components, logic, data structures, and so on that perform particular tasks or implement particular abstract data types. The computing device 109 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 4, the computing device 109 is in the form of a general-purpose computing device that is improved upon by the operation and functionality of the computing device 109, its methods, and/or elements thereof. The components of the computing device 109 may include, but are not limited to, one or more processors or processing units (e.g., processor 414), a memory 416, and a bus (or communication channel) 418 which may take the form of a bus, wired or wireless network, or other forms, that couples various system components including to the processor 414 and the system memory 416. The computing device 109 also typically includes a variety of computer system readable media. Such media may be any available media that is accessible by the computing device 109, and it includes both volatile and non-volatile media, removable and non-removable media.

The processor 414 may receive computer readable program instructions from the memory 416 and execute these instructions, thereby performing one or more processes defined above. The processor 414 may include any processing hardware, software, or combination of hardware and software utilized by the computing device 414 that carries out the computer readable program instructions by performing arithmetical, logical, and/or input/output operations. Examples of the processor 414 include, but are not limited to an arithmetic logic unit, which performs arithmetic and logical operations; a control unit, which extracts, decodes, and executes instructions from a memory; and an array unit, which utilizes multiple parallel computing elements.

The memory 416 may include a tangible device that retains and stores computer readable program instructions, as provided by the intelligent building systems 100, 300, for use by the processor 414 of the computing device 109. The memory 416 can include computer system readable media in the form of volatile memory, such as random access memory 420, cache memory 422, and/or the storage system 424.

By way of example only, the storage system 424 can be provided for reading from and writing to a non-removable, non-volatile magnetic media (not shown and typically called a "hard drive", either mechanical or solid-state). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to the bus 418 by one or more data media interfaces. As will be further depicted and described below, the memory 416 may include at least one program product having a set (e.g., at least one) of program modules that are configured to carry out the operations of embodiments of the invention. The storage system 424 (and/or memory 416) may include a database, data repository or other data store and may include various kinds of mechanisms for storing, accessing, and retrieving various kinds of data, including a hierarchical database, a set of files in a file system, an application database in a proprietary format, a relational database management system (RDBMS), etc. The storage system 424 may generally be included within the computing device 109, as illustrated, employing a computer operating system such as one of those mentioned above, and is accessed via a network in any one or more of a variety of manners.

Program/utility 426, having a set (at least one) of program modules 428, may be stored in memory 416 by way of example, and not limitation, as well as an operating system, one or more application programs, other program modules, and program data. Each of the operating system, one or more application programs, other program modules, and program data or some combination thereof, may include an implementation of a networking environment. Program modules 428 generally carry out the operations and/or methodologies of embodiments of the invention as described herein (e.g., the process flow 200).

The bus 418 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

The computing device 109 may also communicate via an input/output (I/O) interface 430 and/or via a network adapter 432. The I/O interface 430 and/or the network adapter 432 may include a physical and/or virtual mechanism utilized by the computing device 109 to communicate between elements internal and/or external to the computing device 109. For example, the I/O interface 430 may communicate with one or more external devices 440 (e.g., the user device 312), such as a keyboard, a pointing device, a display 442 (e.g., the display 111), etc.; one or more devices that enable a user to interact with the computing device 109; and/or any devices (e.g., network card, modem, etc.) that enable the computing device 109 to communicate with one or more other computing devices. Further, the computing device 109 can communicate with one or more networks such as a local area network (LAN), a general wide area network (WAN), and/or a public network (e.g., the Internet) via network adapter 432. Thus, I/O interface 430 and/or the network adapter 432 may be configured to receive or send signals or data within or for the computing device 109. As depicted, the I/O interfaces 430 and the network adapter 432 communicates with the other components of the computing device 109 via the bus 418. It should be understood that although not shown, other hardware and/or software components could be used in conjunction with the computing device 109. Examples, include, but are not limited to: microcode, device drivers, redundant processing units, external disk drive arrays, RAID systems, tape drives, and data archival storage systems, etc.

While single items are illustrated for the intelligent building systems 100, 300 and the computing device 109 (and other items) by the Figures, these representations are not intended to be limiting and thus, any items may represent a plurality of items. In general, computing devices may include a processor (e.g., a processor 414 of FIG. 4) and a computer readable storage medium (e.g., a memory 416 of FIG. 4), where the processor receives computer readable program instructions, e.g., from the computer readable storage medium, and executes these instructions, thereby performing one or more processes, including one or more of the processes described herein.

Computer readable program instructions may be compiled or interpreted from computer programs created using assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on a computing device, partly on the computing device, as a stand-alone software package, partly on a local computing device and partly on a remote computer device or entirely on the remote computer device. In the latter scenario, the remote computer may be connected to the local computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention. Computer readable program instructions described herein may also be downloaded to respective computing/processing devices from a computer readable storage medium or to an external computer or external storage device via a network (e.g., any combination of computing devices and connections that support communication). For example, a network may be the Internet, a local area network, a wide area network and/or a wireless network, comprise copper transmission cables, optical transmission fibers, wireless transmission, routers, firewalls, switches, gateway computers and/or edge servers, and utilize a plurality of communication technologies, such as radio technologies, cellular technologies, etc.

Computer readable storage mediums may be a tangible device that retains and stores instructions for use by an instruction execution device (e.g., a computing device as described above). A computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Thus, the intelligent building system and method and/or elements thereof may be implemented as computer readable program instructions on one or more computing devices, stored on computer readable storage medium associated therewith. A computer program product may comprise such computer readable program instructions stored on computer readable storage medium for carrying and/or causing a processor to carry out the operations of building system and method. The intelligent building system, as implemented and/or claimed, improves the functioning of a computer and/or processor itself by enabling a seamless user experience between elevators and system through providing elevator information, including cab occupancy information with anonymity, to elevator users. In this way, the embodiments of the present invention improve upon existing building and elevator schemes by adding/modifying operations and/or devices of those schemes to present the occupancy of the elevator to eliminate annoyance and stress of the users (e.g., waiting passengers).

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general-purpose computer, special-purpose computer, or other programmable data processing apparatus to produce a machine, such that the instructions, which execute via the processor of the computer or other programmable data processing apparatus, create means for implementing the operations/acts specified in the flowchart and/or block diagram block or blocks. These computer readable program instructions may also be stored in a computer readable storage medium that can direct a computer, a programmable data processing apparatus, and/or other devices to operate in a particular manner, such that the computer readable storage medium having instructions stored therein comprises an article of manufacture including instructions which implement aspects of the operation/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the operations/acts specified in the flowchart and/or block diagram block or blocks.

The flowchart and block diagrams in the Figures illustrate the architecture, operability, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical operation(s). In some alternative implementations, the operations noted in the block may occur out of the order noted in the figures. For example, two blocks shown in succession may, in fact, be executed substantially concurrently, or the blocks may sometimes be executed in the reverse order, depending upon the operability involved. It will also be noted that each block of the block diagrams and/or flowchart illustration, and combinations of blocks in the block diagrams and/or flowchart illustration, can be implemented by special purpose hardware-based systems that perform the specified operations or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A method, comprising:

detecting an occupancy of an elevator cab of an elevator to generate occupancy information;

generating anonymized occupancy information based on the occupancy information; and providing the anonymized occupancy information to a device communicatively coupled to a display, the device utilizing the anonymized occupancy information to present an image rectified with obscuration via a display, the image rectified with the obscuration depicts the occupancy of the elevator cab anonymity for occupants.

2. The method of claim 1, wherein the detecting of the occupancy of the elevator cab of the elevator to generate occupancy information further comprises capturing by a detector images of an inside of the elevator cab.

3. The method of claim 1, wherein the occupants include mobile entities and accoutrement of the mobile entities.

4. The method of claim 1, wherein a display in an elevator lobby is configured to perform the providing of the anonymized occupancy information.

5. The method of claim 1, further comprising:

receiving a request for the occupancy information initiated by a device external to the processor.

6. The method of claim 1, wherein a computing device of an elevator sub-system is configured to control operations of the elevator including a bypass feature with respect to the occupancy of the elevator cab.

7. The method of claim 1, wherein the occupancy information includes a total number of occupants or a location of each occupant.

8. A system, comprising:

a detector configured to detect an occupancy of an elevator cab of an elevator and to provide occupancy information based on the detection of the occupancy;

a processor, communicatively coupled to the detector, configured to receive the occupancy information from the detector, to generate anonymized occupancy information based on the occupancy information, and to generate an image rectified with obscuration utilizing the anonymized occupancy information; and a display, communicatively coupled to the processor, configured to receive and present the image rectified with the obscuration, the image rectified with the obscuration depicts the occupancy of the elevator cab anonymity for occupants.

9. The system of claim 8, wherein the detector is a camera configured to capture images of an inside of the elevator cab in support of the detecting of the occupancy of the elevator cab of the elevator to generate occupancy information.

10. The system of claim 8, wherein the occupants include mobile entities and accoutrement of the mobile entities.

11. The system of claim 8, wherein a display in an elevator lobby is configured to perform the providing of the anonymized occupancy information.

12. The system of claim 8, wherein the processor is configured to receive a request for the occupancy information initiated by a device external to the processor.

13. The system of claims 8, wherein the processor is a computing device of an elevator sub-system of the system, and wherein the computing device is configured to control operations of the elevator including a bypass feature with respect to the occupancy of the elevator cab.

14. The system of claims 8, wherein the occupancy information includes a total number of occupants or a location of each occupant.

* * * * *